United States Patent [19]

Laramie

[11] Patent Number: 4,496,123

[45] Date of Patent: Jan. 29, 1985

[54] EXTENDABLE SUPPORT

[76] Inventor: Roland A. Laramie, 13 Cedar Dr., Sterling, Va. 22170

[21] Appl. No.: 449,673

[22] Filed: Dec. 14, 1982

[51] Int. Cl.[3] ..... F16L 3/00

[52] U.S. Cl. ..... 248/121; 232/38; 248/124

[58] Field of Search ..... 248/121, 122, 124, 125, 248/145, 149, 128, 104, 106, 278, 279, 291, 150; 232/38, 39

[56] References Cited

U.S. PATENT DOCUMENTS

| | | | |
|---|---|---|---|
| 961,552 | 6/1910 | Stouffer | 248/278 |
| 1,508,715 | 9/1924 | Norman | 248/278 |
| 2,458,950 | 1/1949 | Luzardo | 248/124 |
| 2,470,694 | 5/1949 | Foo | 248/124 |
| 3,151,595 | 10/1964 | Stainbrook | 248/124 |
| 3,229,940 | 1/1966 | Kagels | 248/124 |
| 3,497,078 | 2/1970 | Nash | 232/39 |
| 4,047,684 | 9/1977 | Kobayashi | 248/122 |
| 4,402,481 | 9/1983 | Sasaki . | |

FOREIGN PATENT DOCUMENTS

| | | | |
|---|---|---|---|
| 279918 | 11/1927 | United Kingdom | 248/124 |

*Primary Examiner*—William H. Schultz
*Assistant Examiner*—Ramon O. Ramirez
*Attorney, Agent, or Firm*—Robbins & Laramie

[57] ABSTRACT

An extendable support is provided for selectively supporting a mailbox in either an extended or unextended position. The support generally comprises a hollow, elongated support member, and an extension arm which carries the mailbox and which is slidably extendable out of and retractable into the hollow interior of the support member. The extension arm includes a proximal pivotable mounting for mounting the mailbox into an extended position when the arm is slidably extended out of the interior of the support member and pivoted. The extension arm also includes a distal pivotal mounting for maintaining the mailbox in a horizontal orientation after the arm is slidably extended out of the hollow interior of the support member and pivoted.

20 Claims, 17 Drawing Figures

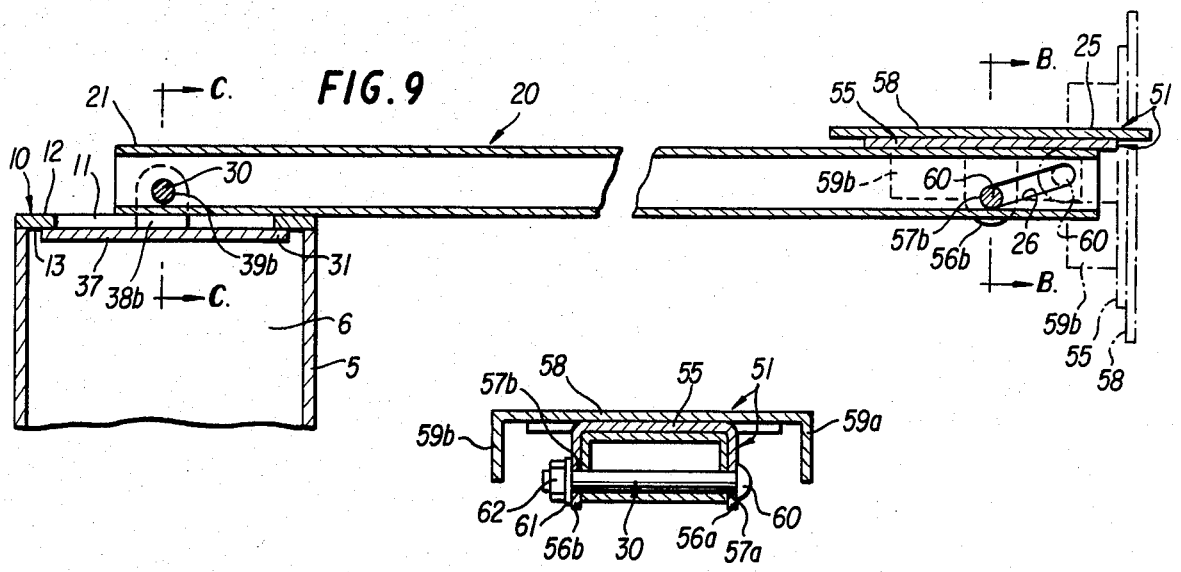
FIG. 9
FIG. 10
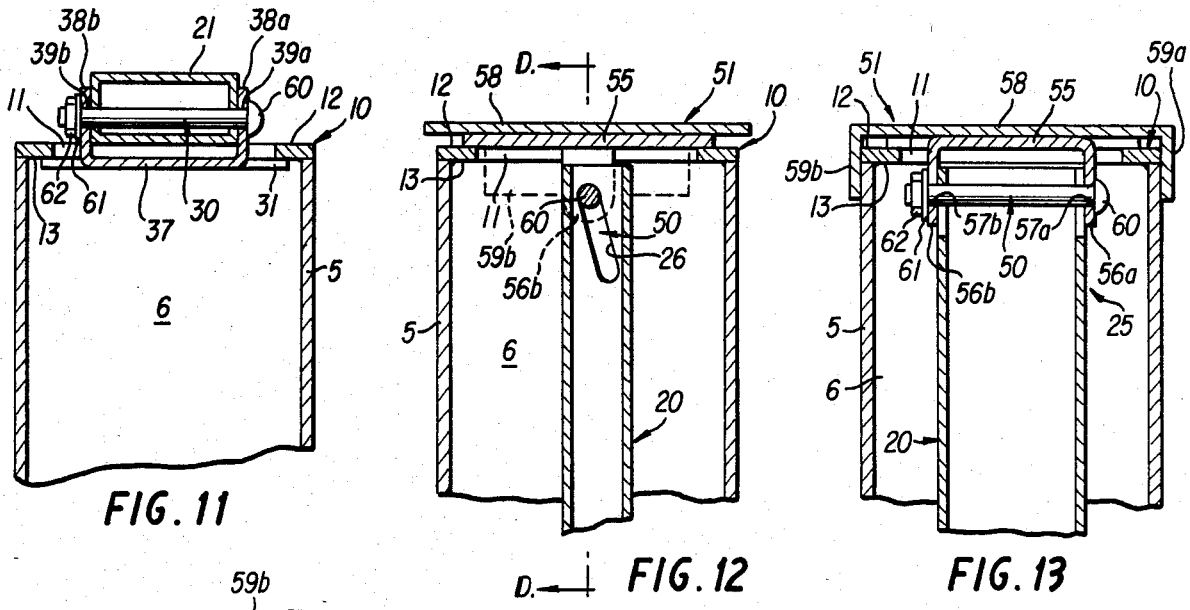
FIG. 11
FIG. 12
FIG. 13
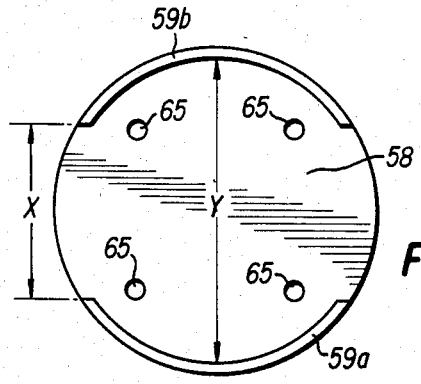
FIG. 14

EXTENDABLE SUPPORT

BACKGROUND OF THE INVENTION

1. Field of the Invention

The invention relates to an extendable support and is particularly adapted for use with rural mailboxes located along a roadside.

2. Description of the Prior Art

Rural mailboxes are generally mounted on posts secured in the ground along the roadside. In northern rural parts of the country, the large amount of snowfall during the winter months necessitates frequent snow plowing which in turn results in large snow banks along the roadside. These snow banks often bury most or all of the mailbox and its support, thereby rendering it inaccessible to the deliverer of the mail. Frequently, the mailbox and support are struck by a snowplow, causing damage to both. In southern rural parts of the country, the roadways have little or no shoulders, and drop off sharply into drainage ditches running along the sides of the roadways. The mailboxes which are mounted on posts placed in these narrow shoulders are so close to the edge of the roadway that they are frequently struck and damaged by passing vehicles.

Numerous attempts have been made to avoid both of these problems. Many of these involve the mounting of the mailbox at the end of a horizontal arm attached to a support post. Because the mailbox extends out from the post and is closer to the road, it is more accessible to the mail deliverer. If the banks of snow made by the snowplow are small, only part of the post will be buried in the snow. However, because the mailbox is more accessible, it is also more likely to be struck by a snowplow or other passing vehicle and severely damaged.

Typical mailbox supports in which the mailbox is mounted on a horizontal arm extending out from a post anchored in the ground are disclosed in U.S. Pat. Nos. 730,806, 839,607, 910,613, 969,965, 1,430,476, 1,645,768, 1,958,677, 2,550,338, 3,465,944, 3,870,262, 3,881,650, 4,113,213, 4,130,239 and 4,264,032. Each of these prior art supports has drawbacks which have prevented it from being an ideal solution to the problems discussed above. For example, the extension arms disclosed in U.S. Pat. Nos. 730,806, 839,607, 910,613, 969,965, 1,430,476 and 1,958,677 are rigidly attached to the vertical supporting post so that if they are struck by a passing vehicle they will be extensively damaged and most likely broken off from the vertical post. U.S. Pat. Nos. 4,113,213 and 4,130,239 disclose mailbox supports rotatably mounted to arms which are rigidly supported by vertical posts. Because the arms are secured rigidly to the posts, the mailboxes mounted on the rotatable supports would still be extensively damaged upon being struck by a passing vehicle. U.S. Pat. Nos. 1,645,768, 2,550,338 and 3,881,650 disclose mailbox supports having horizontal supporting arms pivotally secured to the vertical posts and provided with spring means for returning the horizontal arms to their original location after they have been struck by passing vehicles. However, the construction of these supports is mechanically complex, which impedes the practicality of these designs. U.S. Pat. No. 4,264,032 discloses a hinged, foldable mailbox arm for curb-to-door mail retrieval that is likewise mechanically complex, and hence less than an ideal solution to the problem. Finally, U.S. Pat. No. 3,870,262 discloses a mailbox support having a swingable horizontal bar which when struck disengages from its support and lands upon the ground along the side of the road. However, when struck by a snowplow, a mailbox having such a support would be knocked to the ground and quickly covered with the snow being removed from the roadway. Such a mailbox buried in snow could easily be inadvertently crushed by either the snowplow or any other passing vehicle.

Thus, there is clearly a need for a mailbox support which provides a practical, simple and economical solution to the serious problems associated with rural roadside mailboxes.

SUMMARY OF THE INVENTION

The invention relates to a mailbox support having a self-storing extension arm which solves the aforementioned problems associated with prior art mailbox supports. In its most general form, the invention is an extendable support having an extension arm capable of assuming either an extended or an unextended position, and a support member having a recess for storing the arm when the support member is in the unextended position. The extension arm may connect a mailbox with the support member, and is slidably extendable out of and retractable into the storage recess of the support member. The extension arm includes a proximal pivotal mounting for mounting the mailbox into the extended position when the arm is fully extended out of the storage recess and pivoted toward the horizontal. The extension arm also includes a distal pivotal mounting for reorienting the mailbox back into an operable position after the mailbox has been placed into an extended position, or placed back into an unextended position.

The supporting member may be an elongated member having a hollow interior for storing the arm, such as a pipe. The pipe may terminate in a wall having an aperture through which the arm may be slidably extended or retracted. The proximal pivotal mounting may include a stopping means larger than the diameter of the aperture in the terminal wall of the support pipe for stopping the arm from being completely withdrawn from the hollow interior of the support pipe. The arm may further include a locking or securing means for locking or securing the arm into the extended position after the arm is withdrawn and pivoted into the extended position.

In one embodiment of the present invention, the stopping means of the proximal pivotal mounting of the extension arm includes a T-shaped plate, and the locking or securing means includes an elongated tongue connected to the mailbox at one end and extending to the T-shaped plate at the other end. The hat of the T-shaped plate stops the arm from being completely withdrawn through the aperture in the terminal wall of the support pipe. When the arm is vertically withdrawn and pivoted toward the horizontal so that the hat of the T abuts the inside of the terminal wall of the support pipe, and the mailbox is pivoted back into its original position via the distal pivotal mounting, the elongated tongue connected to the mailbox extends through an aperture in the body of the T-shaped plate adjacent to the upper side of the terminal wall into a securing position.

In another embodiment, the stopping means includes a round plate attached to the proximal end of the extension arm. This round plate includes a pair of opposing ears projecting from the upper side of the plate which extend through the aperture in the terminal wall of the support pipe when the arm is extended. Each of these ears includes a pin-receiving aperture. The proximal end of the arm includes a pin-receiving slot. When the pin-receiving apertures of the ears are placed in registry with the pin-receiving slot of the arm and a pin is inserted therethrough, the proximal end of the arm is pivotally and slidably mounted between the ears of the round plate. When the arm is extended and pivoted into a horizontal, extended position, the slot allows the proximal end of the arm to slide over the upper surface of the terminal wall of the hollow support pipe into a locking or securing position. The distal end of the arm may also include a slot, and the distal pivotal mounting may also include a round plate having a pair of ears with pin-receiving apertures for pivotally mounting the mailbox onto the distal end of the arm and slidably locking or securing the mailbox back into its original orientation after the arm is extended.

In a third embodiment of the invention, the distal pivotal mounting may include first and second pairs of opposing ears with pin-receiving apertures which may be placed into registry with a pin-receiving slot and aperture in the distal end of the arm, respectively. The second pair of ears may function to secure the orientation of the extended mailbox when the pin-receiving apertures in these ears are aligned with apertures in the distal end of the arm and a securing pin is inserted through the pin-receiving apertures. Additionally, the terminal wall of the support post includes a pair of slots for receiving the second pair of ears and securing the mailbox in the unextended position when a securing pin is inserted through the pin-receiving apertures in these ears on the underside of the terminal wall.

In all embodiments, the extended arm is rotatable about the support member so that it will easily swing to the side with minimal damage if struck by a passing vehicle.

BRIEF DESCRIPTION OF THE DRAWINGS

FIG. 9 is a side, cross-sectional view of the mailbox support shown in FIG. 8;

FIG. 10 is a back, cross-sectional view of the mailbox support shown in FIG. 9, taken along line B—B;

FIG. 11 is a back, cross-sectional view of the mailbox support shown in FIG. 9, taken along line C—C;

FIG. 12 is a side, cross-sectional view of the mailbox support of FIG. 7 shown assembled and in its unextended position;

FIG. 13 is a back, cross-sectional view of the mailbox support of FIG. 12, taken along line D—D;

FIG. 14 is a bottom, plan view of the top mailbox plate of the second embodiment of the invention;

DETAILED DESCRIPTION OF THE PREFERRED EMBODIMENTS

Figure 15:
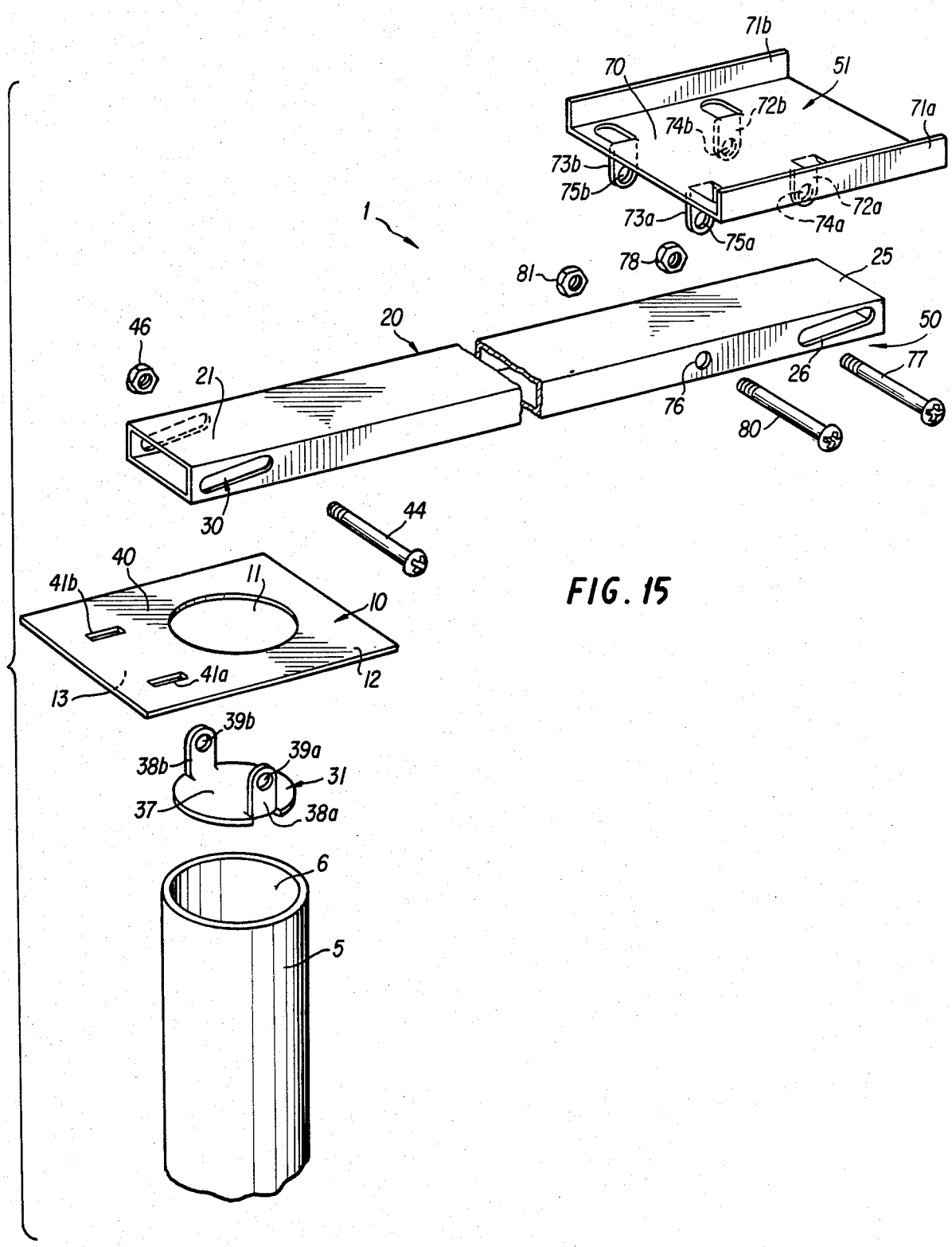
FIG. 15 is a perspective exploded view of a third embodiment of the invention in an extended position.
Figure 16:
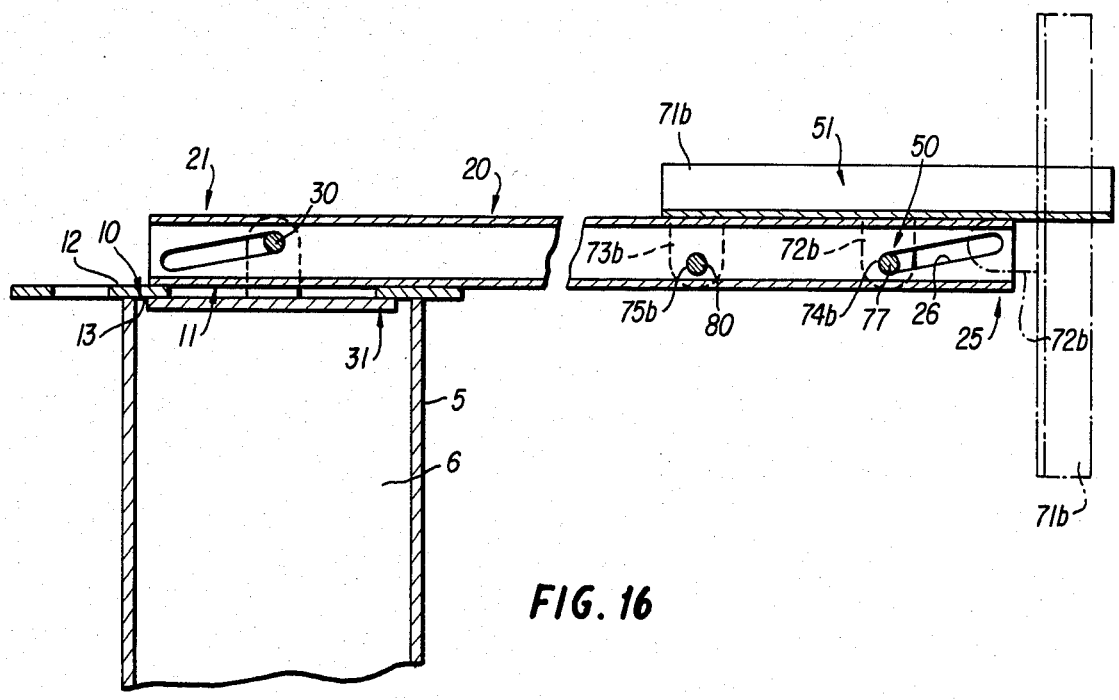
FIG. 16 is a side, cross-sectional view of the third embodiment of the invention, assembled and extended.
Figure 17:
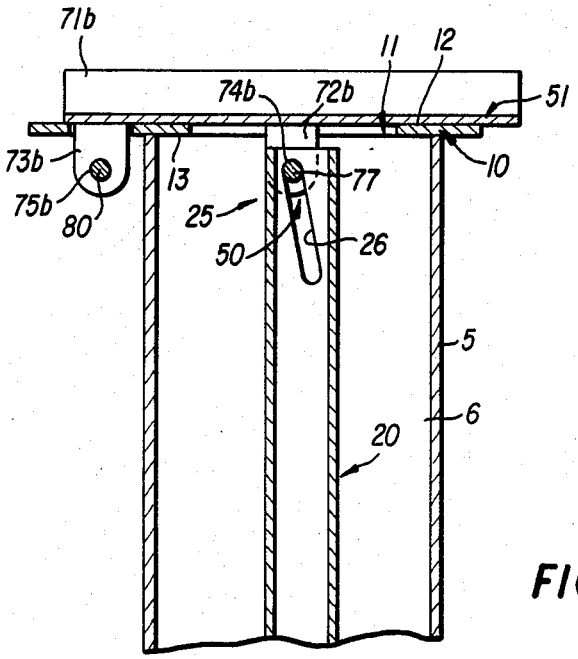
FIG. 17 is a side, cross-sectional view of the third embodiment of the invention, assembled and unextended.

There are three preferred embodiments of the invention, including a first preferred embodiment illustrated in FIGS. 1–6, a second preferred embodiment illustrated in FIGS. 7–14, and a third preferred embodiment illustrated in FIGS. 15–17. With reference to all of these figures, wherein like reference numerals refer to like parts, each of the embodiments 1 of the invention includes a support member 5 having a storage recess 6 for storing an extension arm 20. The support member 5 in each embodiment is preferably a hollow pipe. In each of the embodiments, the support member 5 includes a terminal wall 10 including an aperture 11 through which the extension arm 20 may be slidably extended out of or retracted into the storage recess formed from the hollow interior of the pipe support member 5. In all three embodiments, the extension arm 20 includes a proximal end 21, and a distal end 25 having an elongated slot 26. The elongated slot 26 is preferably diagonally disposed relative to the longitudinal axis of the extension arm 20, as illustrated. Elongated slot 26 is part of the distal pivotal mounting 50 which pivotally attaches mailbox 2 to the distal end 25 of arm 20, as will be described in more detail hereinafter. Each of the three embodiments further includes a proximal pivotal mounting 30 for pivotally mounting the arm 20 to the terminal wall 10 of the support member 5. Proximal pivotal mounting 30 includes a stopping means 31 for stopping the extension arm 20 from being completely withdrawn out of the storage recess 6 of support member 5 incident to placing arm 20 in an extended position. Finally, the extension arm 20 includes a distal pivotal mounting 50 for pivotally mounting the mailbox 2 to the distal end 25 of the arm 20. Distal pivotal mounting 50 allows the mailbox 2 to be reoriented into a horizontal position after the arm 20 is withdrawn from storage recess 6 and pivoted into an extended position. Distal pivotal mounting 50 includes a mailbox plate 51 which is pivotally mounted to the distal end of the arm 20 via elongated slot 26.

Figure 1:
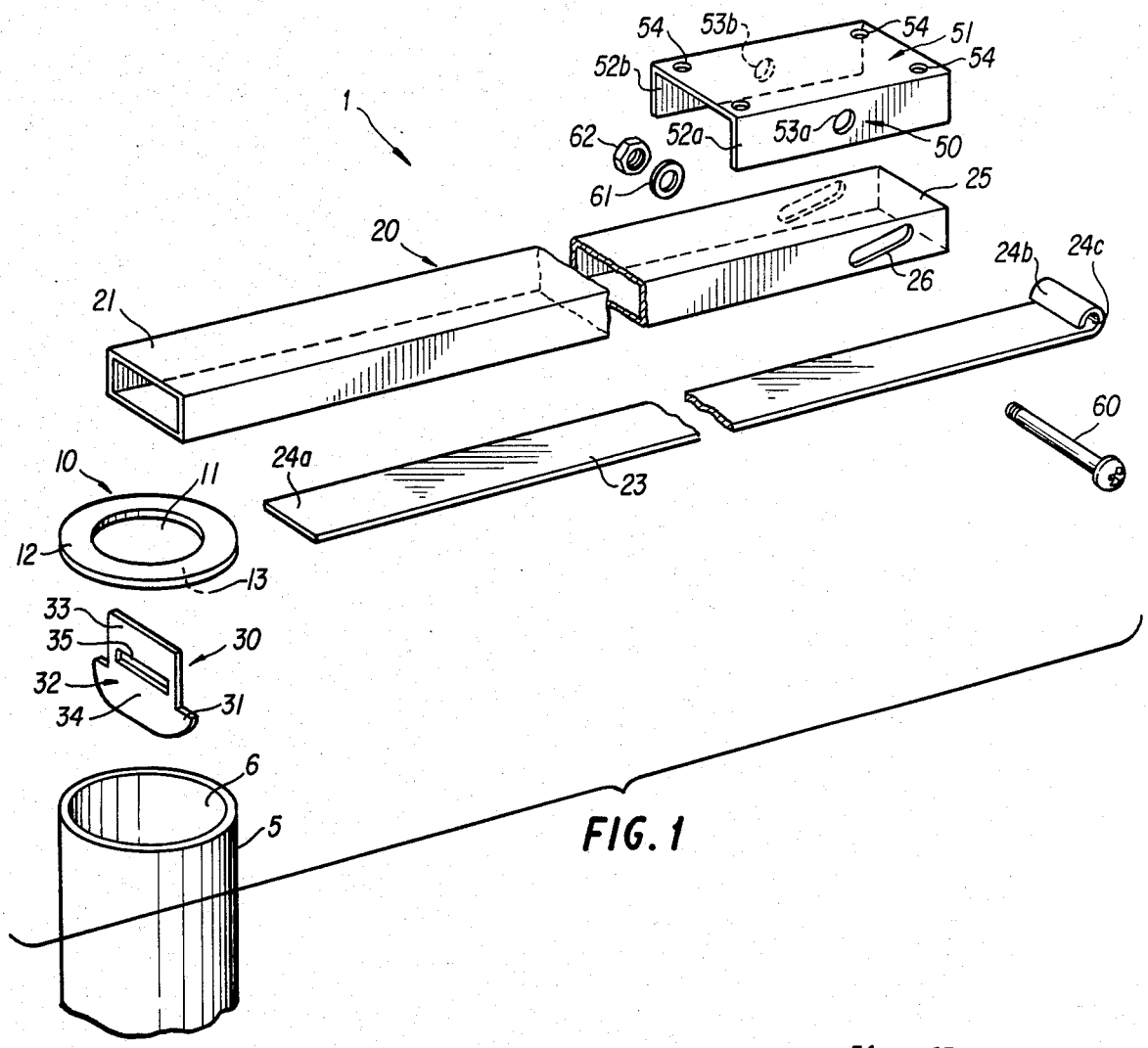
FIG. 1 is an exploded perspective view of a first embodiment of a mailbox support in accordance with the present invention.
Figure 2:
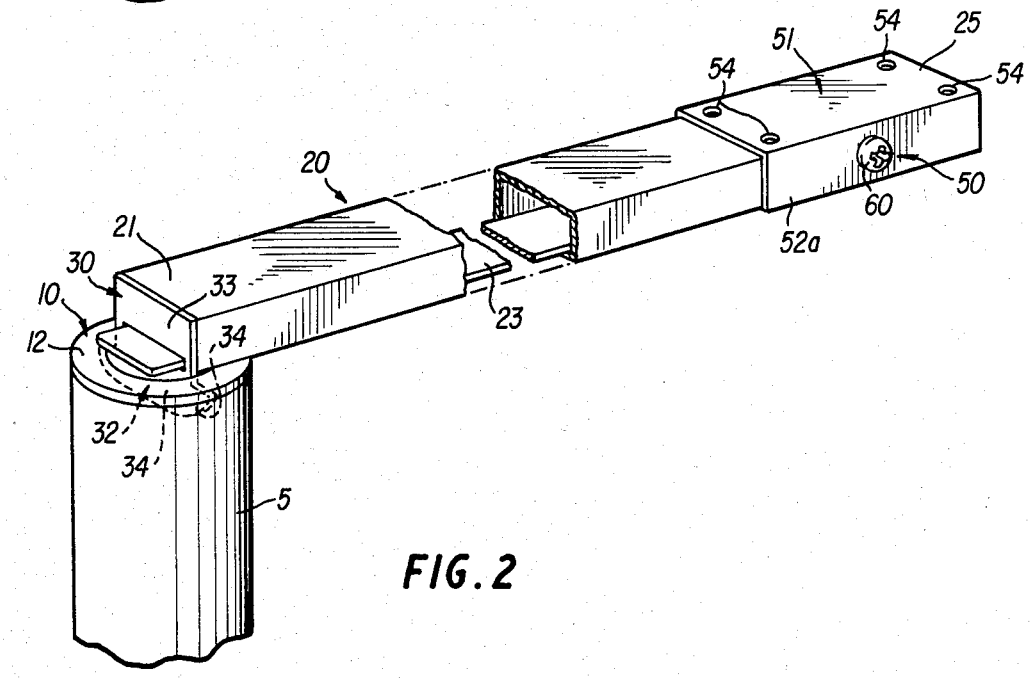
FIG. 2 is a perspective view of the mailbox support of FIG. 1, shown assembled and in its extended position.

With specific reference now to FIGS. 1 and 2, the first preferred embodiment of the extendable mailbox support 1 of the invention includes a pipe support member 5 having a ring-shaped terminal wall which includes an aperture 11 through which extension arm 20 is slidably extendable out of, and retractable into, the storage recess 6 of pipe support member 5. The proximal end 21 of extension arm 20 includes a stopping means 31 in the form of a T-shaped plate 32. The body 33 of the T-shaped plate 32 is attached to the proximal end 21 of the extension arm 20, while the hat 34 of the T-shaped plate 32 hangs under the bottom of the proximal end 21 of the arm 20, as shown. The hat 34 of the T-shaped plate 32 functions as the stopping means 21 in the first embodiment since the width of the hat 34 is larger than the diameter of aperture 11 in terminal wall 10. Additionally, T-shaped plate 32 includes a tongue-receiving slot 35 for locking extension arm 20 into an extended position in a manner which will be explained in detail hereinafter. It should be noted that tongue-receiving slot 35 is located slightly above the upper surface 12 of terminal wall 10 when arm 20 is placed in the extended position, as illustrated in FIG. 2.

Figure 3:
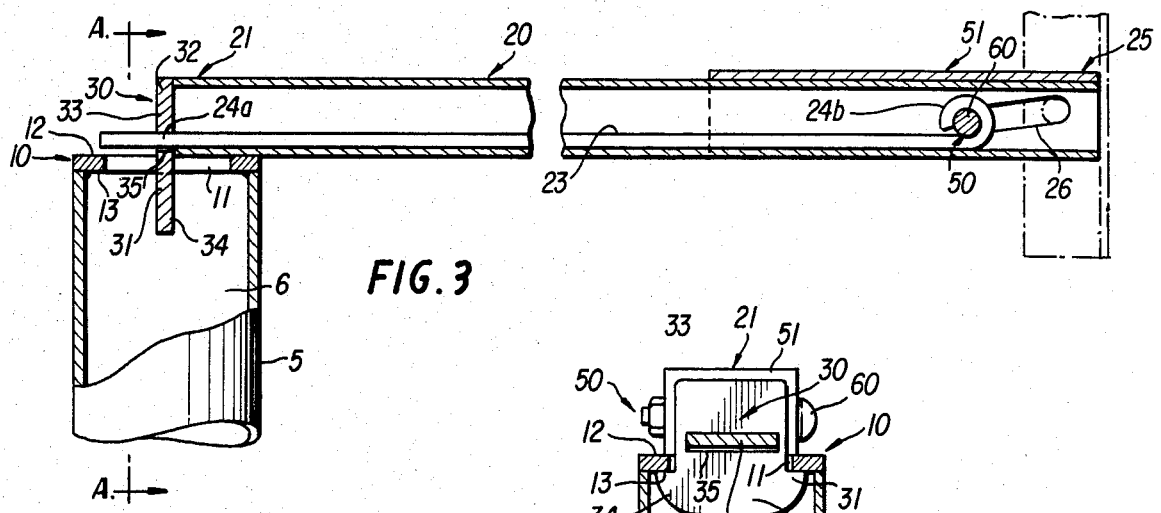
FIG. 3 is a side, cross-sectional view of a mailbox support in accordance with the first embodiment of the present invention which is in its extended position.
Figure 4:
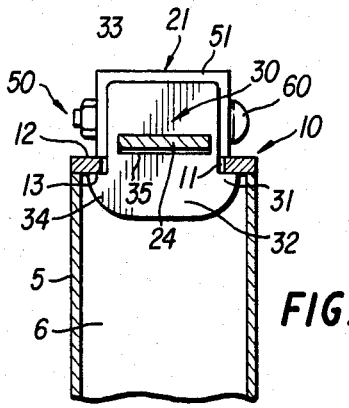
FIG. 4 is a cross-sectional view taken along line A—A of FIG. 3.

With specific reference to FIGS. 1, 2 and 3, extension arm 20 is preferably hollow, and includes an elongated tongue 23 which is slidable along the longitudinal axis of the arm 20. Elongated tongue 23 includes a locking portion 24*a*, and a pivot connection portion 24*b* which may be formed by curling the distal end of the elongated tongue 23 as shown. The curl forming the pivot connection portion 24*b* of tongue 23 includes a hollow, cylindrical space 24*c* through which a mounting pin which may be a bolt 60 is inserted.

Again with reference to FIGS. 1–3, the distal pivotal mounting 50 of the extension arm 20 includes a mailbox plate 51 for connecting the mailbox 2 to the distal end of the arm 20. In this first embodiment, mailbox plate 51 is substantially rectangular in shape, and includes a pair of downwardly extending flanges 52*a* and 52*b*, each of which in turn includes a pin-receiving aperture 53*a*, 53*b*. Mailbox plate 51 also preferably includes a plurality of apertures 54 for bolt-mounting the mailbox 2 onto the plate 51.

With specific reference to FIGS. 2 and 3, the distal pivotal mounting 30 is assembled by placing the cylindrical space 24*c* of elongated tongue 23 in alignment with both the slot 26 in the distal end 25 of the arm 20, and placing the pin-receiving apertures 53*a*, 53*b* of mailbox plate 51 in alignment with the cylindrical space 24*c* of elongated tongue 23. When mounting pin 60 is inserted through aperture 53*a* of plate 51, slot 26 of distal end 25, and the cylindrical space 24*c* of elongated tongue 23, plate 51 is pivotally and slidably connected to the distal end 25 of arm 20, while tongue 23 is slidably connected to mailbox plate 51.

Figure 5:
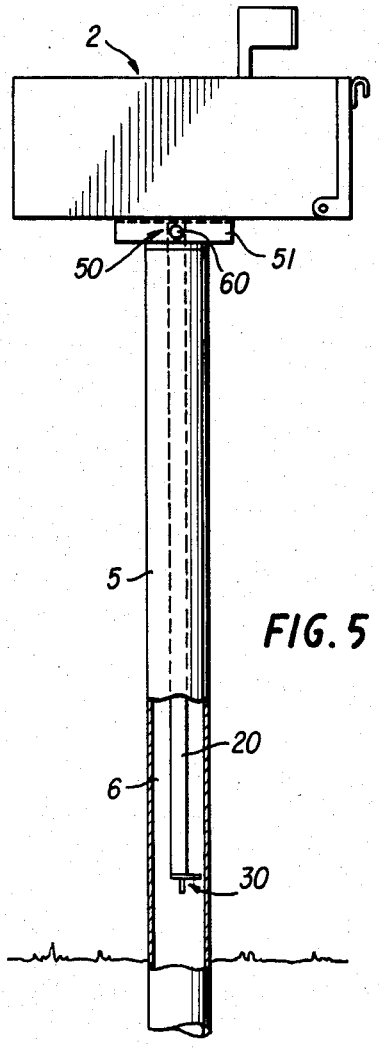
FIG. 5 is a side, elevational view of the first embodiment of the present invention which is in its unextended position.
Figure 6:
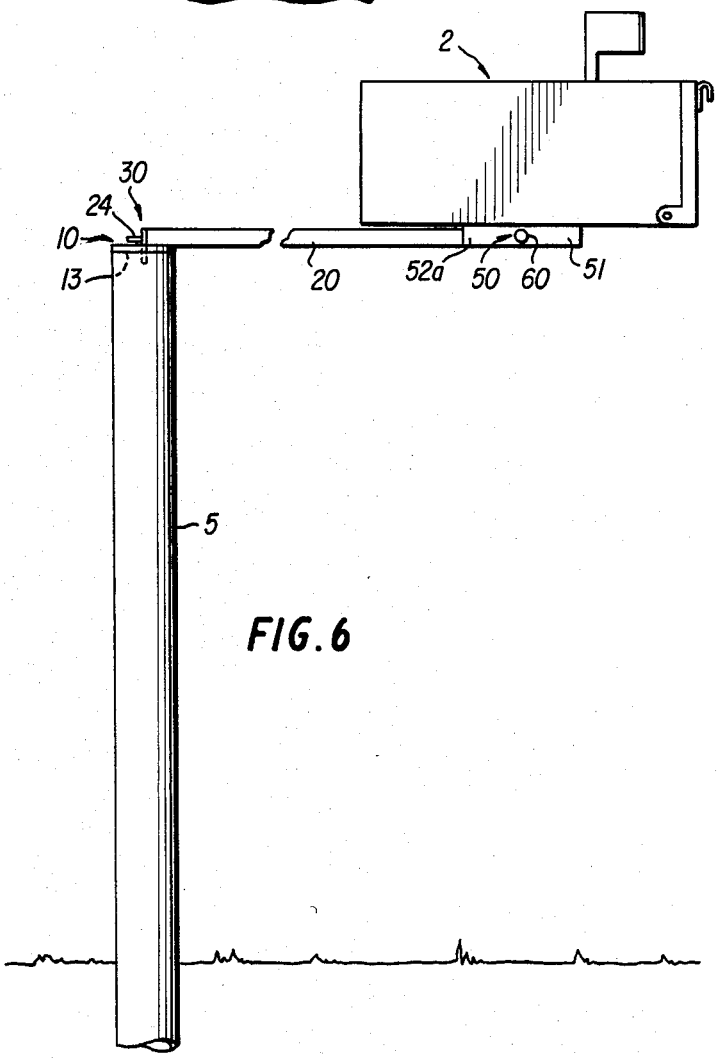
FIG. 6 is a side, elevational view of the first embodiment of the present invention which is in its extended position.

In operation, the extendable mailbox support 1 is stored within the recess 6 or hollow interior of the pipe support member 5 as illustrated in FIG. 5. Mailbox plate 51 is disposed ninety degrees clockwise from the position shown in FIG. 3 by virtue of the fact that, when the support 1 is in its unextended position, pivotal mounting pin 60 is disposed over to the extreme right of slot 26 which in turn allows mailbox plate 51 to assume the position illustrated in FIG. 5. When the extension arm 20 is vertically withdrawn until the hat of the T-shaped plate abuts the lower surface of terminal wall 10 and the arm is rotated ninety degrees clockwise, the extension arm assumes the extended position illustrated in FIG. 6. To reorient the mailbox back into its horizontal position, mailbox 2 is simply rotated ninety degrees counterclockwise after the extension arm 20 is withdrawn and pivoted into the position illustrated in FIG. 6. To secure or lock the arm 20 into the extended position, mailbox plate 51 is slid in a direction toward the support member 5 until pivotal mounting pin 60 is pushed all the way to the extreme left side of slot 26 at the distal end 25 of arm 20. The sliding of mailbox plate 51 in the position shown in FIG. 3 extends the locking portion 24*a* of the elongated tongue 23 through the tongue-receiving slot 35 in the body of the T-shaped plate 33, as shown. The locking portion 24*a* of elongated tongue 23 overhangs and abuts the upper surface 12 of terminal wall 10, as shown in FIGS. 2 and 3. Such positioning of the locking portion 24*a* of elongated tongue 23 locks the arm 20 by preventing it from being pivoted upwardly, while the stopping means 31 in the form of the hat 34 of the T-shaped plate 32 against the lower surface 13 of the terminal wall 10 prevents the extension arm 20 from being pivoted downwardly. To unlock the arm, the mailbox plate 51 is slid back in a direction away from support member 5 until pivotal mounting pin 60 is pulled all the way back toward the extreme right side of slot 26. This action withdraws the locking portion 24*a* of the elongated tongue 23 out of the tongue-receiving slot 35 of the body of the T-shaped plate 33 and allows arm 20 to be pivoted into a vertical direction, where it may be slid back into storage recess 6 into the position illustrated in FIG. 5. It should be noted that the structure of the proximal pivotal mounting 30 allows the arm 20 to rotate about support member 5 when the extension arm 20 is in the extended position should mailbox 2 be struck by a passing vehicle.

Figure 7:
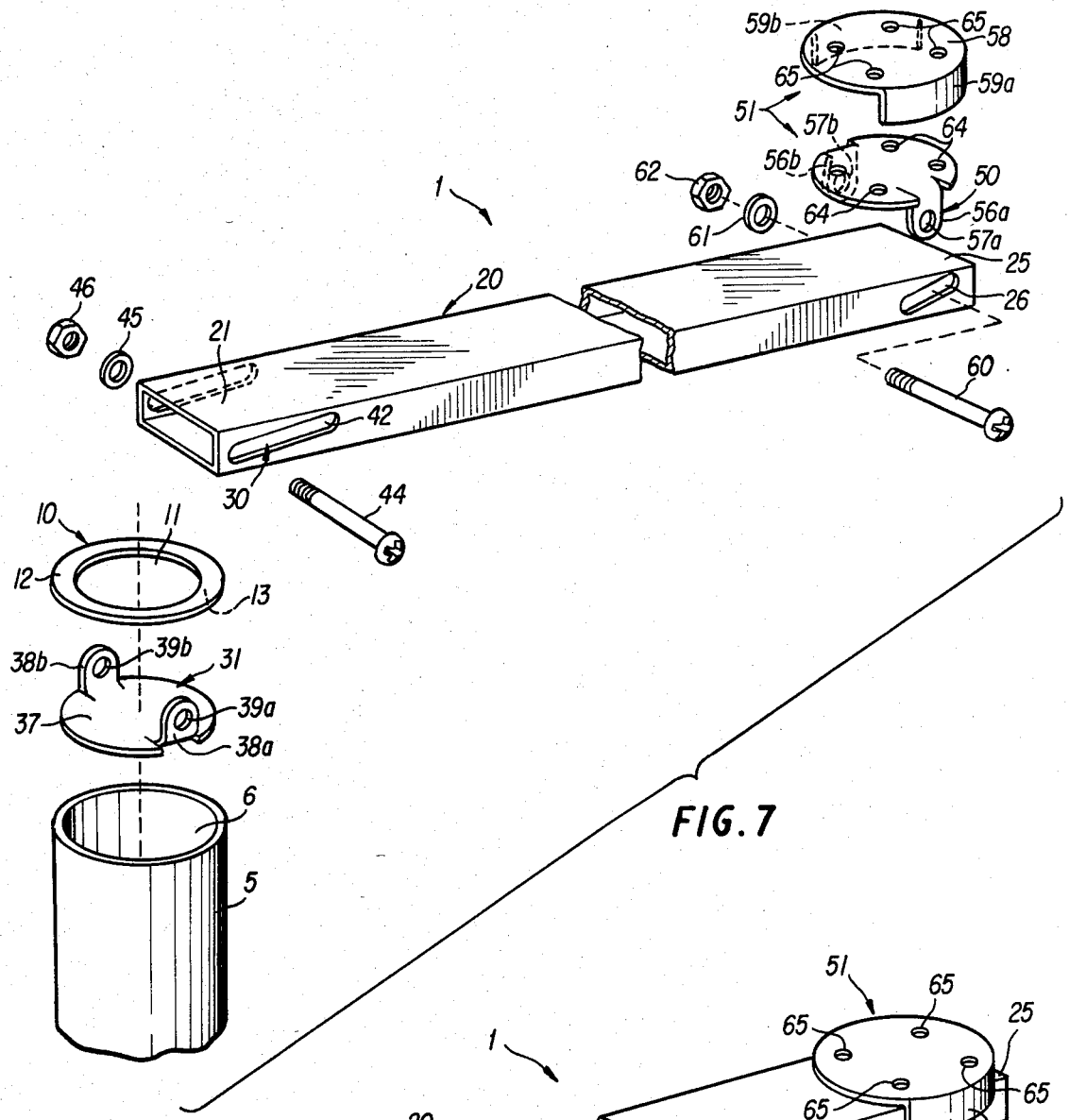
FIG. 7 is an exploded perspective view of a second embodiment of a mailbox support in accordance with the present invention.
Figure 8:
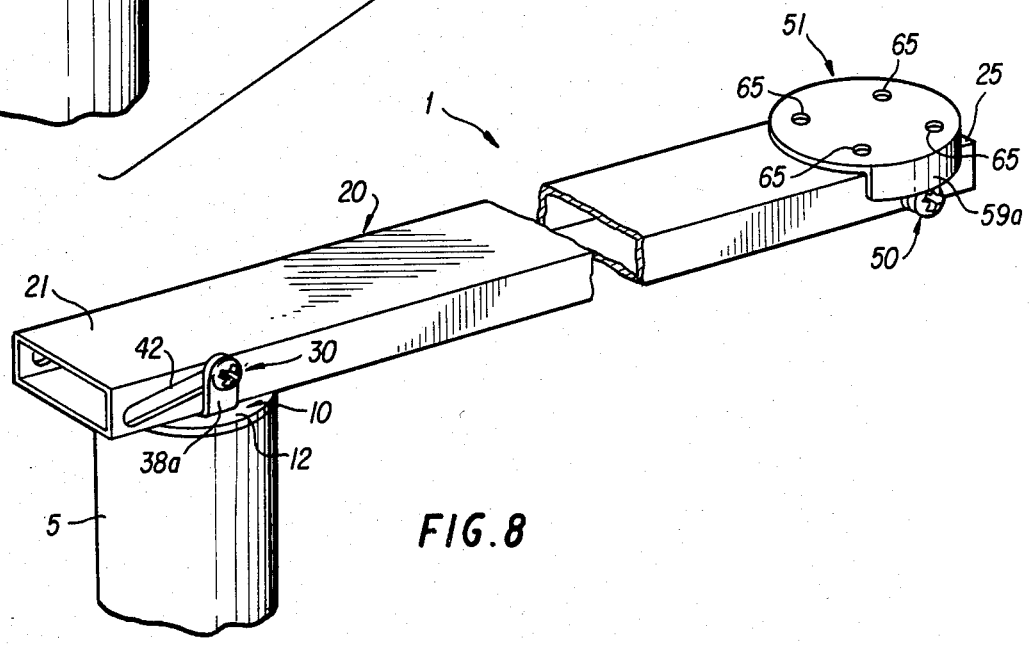
FIG. 8 is a perspective view of the mailbox support of FIG. 7 shown assembled and in its extended position.

With reference now to FIGS. 7 and 8, the second embodiment of the invention likewise includes a pipe support member 5 having a storage recess 6 formed by its hollow interior, an extension arm 20, a proximal pivotal mounting 30 and a distal pivotal mounting 50. Like the first embodiment, the pipe support member 5 includes a ring-shaped terminal wall 10 having an aperture 11 through which the extension arm 20 may be withdrawn or inserted. However, the proximal pivotal mounting 30 of the second embodiment differs from the proximal pivotal mounting 30 of the first embodiment in several fundamental ways. The stopping means 31, instead of being a T-shaped plate, is a substantially round plate 37 having a pair of opposing ears 38*a*, 38*b*. Each of the ears 38*a*, 38*b* includes a pin-receiving aperture 39*a*, 39*b*, respectively. The distance between the ears 38*a*, 38*b* is less than the diameter of the aperture 11 in the terminal wall 10 of support member 5. Hence, a ring-shaped portion of the periphery of the round plate 37 acts as the stopping means 31 of the extension arm 20 when the arm 20 is slidably withdrawn from the recess 6 in pipe support member 5.

Another fundamental difference between the first and second embodiments is the structure of the proximal end 21 of the extension arm 20. Proximal end 21 includes an elongated, pin-receiving slot 42. When the proximal end 21 of the extension arm 20 is slidably disposed between the ears 38*a*, 38*b* of round plate 37 with apertures 39*a*, 39*b* in registration with slot 42, and the entire assembly is assembled with a pin means 44 which may be a bolt and a washer 45 and nut 46, the proximal end 21 of extension arm 20 may serve the same locking or securing function as the locking portion 24*a* of the elongated tongue 23 of the first embodiment. Specifically, as best shown in FIG. 8, the proximal end 21 of extension arm 20 may be slid in a direction toward pipe support member 5 after the arm 20 has been withdrawn and pivoted into the extended position so that the proximal end 21 of the arm 20 overhangs and abuts the upper surface 12 of terminal wall 10. Preferably, slot 42 is diagonally disposed with respect to the longitudinal axis of extension arm 20 so that the proximal end 21 of the extension arm 20 will snugly abut the rear of the upper surface 12 of terminal wall 10 when the arm 20 is in a direction toward support member 5, so that the pin means 44 abuts the extreme right of slot 42. Hence the elongated slot 42 of the proximal end 21 of extension arm 20 obviates the need for the elongated tongue and slot structure used to lock or secure the extension arm 20 in the first embodiment.

It should be noted that the structure of the proximal pivotal mounting 30 allows the extension arm 20 to rotate about pipe support member 5 in the extended position in the event that the mailbox supported on the distal end of arm 20 is struck by a passing vehicle.

With specific reference now to FIGS. 7, 8 and 9, the distal pivotal mounting 50 of the second embodiment likewise varies from the distal pivotal mounting 50 of the first embodiment in several fundamental respects. First, the flanged, rectangular mailbox plate 51 of the first embodiment has been replaced by the combination of a round plate 55 and a round mailbox mounting plate 58. Round plate 55 includes a pair of opposing ears 56*a*, 56*b*. Each of the ears 56*a*, 56*b* includes a pin-receiving aperture 57*a* and 57*b*, respectively. Round plate 55 is preferably the same size as round plate 37 in order to simplify the manufacture of the second embodiment of the invention. Round plate 55 is slidably and pivotally mounted onto the distal end 25 of extension arm 20 via a mounting pin 60 which may be a bolt which threads onto a nut 62 through a washer 61. The mounting pin 60, washer 61 and nut 62 slidably and pivotally mount round plate 55 onto the distal end 25 of the extension arm 20 in the same way that the mounting pin 60 mounts the rectangular mailbox plate 51 in the first embodiment. The round mailbox mounting plate 58 which forms the other part of mailbox mounting plate 51 in the second embodiment includes a pair of arcuate flanges 59*a*, 59*b* extending downwardly from the periphery thereof. Both the round plate 55 and the round mailbox mounting plate 58 preferably include a plurality of apertures 64 and 65, respectively, for mounting a mailbox 2 thereon via a plurality of nuts and bolts (not shown).

With reference now to FIGS. 9–13, when the arm 20 is placed into the extended position best illustrated in FIG. 9, the round mailbox mounting plate 58 complements the mounting function of the round plate 55. Specifically, the two arcuate flanges 59*a*, 59*b* of round mailbox mounting plate 58, like the ears 56*a*, 56*b* of round plate 55, abut the sides of the distal end 25 of arm 20 as shown, thereby slidably and pivotally mounting the entire mailbox plate 51 to the distal end 25 of arm 20. However, when the arm 20 is placed in the unextended position best illustrated in FIGS. 12 and 13, round mailbox mounting plate 58 performs a function distinctly different from round plate 55. In the unextended position, the arcuate flanges 59*a*, 59*b* of mailbox mounting plate 58 hug the outer periphery of the terminal end of support member 5, thereby rotatably mounting the mailbox 2 onto the terminal end of the support member 5 with a minimum of play. Without the arcuate flanges 59*a*, 59*b* of the round mailbox mounting plate 58, the mailbox 2 in the second embodiment would tend to wobble about the terminal end of support member 5 when arm 20 was placed in the unextended position.

With specific reference now to FIG. 14, the dimensioning of round mailbox mounting plate 58 is such that the minimum distance X between the opposing, arcuate flanges 59*a*, 59*b* is equal to or greater than the width of the distal end 25 of extension arm 20. Also, the inner diameter Y between the arcuate flanges 59*a*, 59*b* is a little larger than the diameter of the terminal wall 10 of the support member 5 so that these flanges 59*a*, 59*b* hug the terminal end of support member 5 when extension arm 20 is in the unextended position illustrated in FIG. 13.

With reference now to FIGS. 15–17, the third embodiment of the invention includes a proximal pivotal mounting 30 which is identical to the proximal pivotal mounting 30 of the second embodiment, with one exception. That exception is the structure of the terminal wall 10 of the support member 5. Instead of being the ring-shaped wall of the second embodiment, terminal wall 10 of the third embodiment comprises a rectangular plate 40 having a pair of spaced slots 41*a*, 41*b*, whose function will be explained in detail hereinafter. As indicated in FIG. 15, the portion of the terminal wall 10 which includes slots 41*a*, 41*b* overhangs the rear of support member 5.

With references to FIGS. 15 and 16, the distal pivotal mounting 50 of the third embodiment replaces the pair of round plates 55 and 58 with a single, rectangularly shaped mailbox plate 70. Rectangular plate 70 includes a pair of parallel, opposing flanges 71*a*, 71*b* for receiving the bottom portion of mailbox 2 (not shown). The rear portion of rectangular mailbox plate 70 also includes two pair of opposing ears 72*a*, 72*b* and 73*a*, 73*b*. Each of these pairs of ears is spaced so that it may slidably receive the distal end 25 of extension arm 20. Each of the ears 72*a*, 72*b* and 73*a*, 73*b* includes a pin-receiving aperture 74*a*, 74*b* and 75*a*, 75*b*, respectively. The pin-receiving apertures 74*a*, 74*b* of ears 72*a*, 72*b* may be placed in a registry with slot 26, and the plate 70 may be pivotally and slidably mounted onto the distal end 25 of arm 20 via a pin means 77 which may be a bolt threaded to a nut 78. Thus, ears 72*a*, 72*b* perform the same function for rectangular plate 70 that the ears 56*a*, 56*b* of round plate 55 perform for the second embodiment. However, in contrast to the second embodiment of the invention, the second pair of ears 73*a*, 73*b* provides a means for securing the rectangular mailbox plate 70 back into its horizontal orientation when the mailbox 2 (not shown) is placed into the extended position. When the arm 20 is so extended, the pin-receiving apertures 75*a*, 75*b* of the ears 73*a*, 73*b* may be placed in a registry with a bore 76, and may be secured onto the distal end 25 of arm 20 via a pin means 80 which may be a bolt threaded to a nut 81.

With reference now to FIGS. 15 and 17, when it is desired to place extension arm 20 back into an unextended position, pin means 80 may be removed, and the ears 73*a*, 73*b* may be inserted through slots 41*a*, 41*b* of wall 40. After this is done, the rectangular mailbox plate 70 may be secured onto terminal wall 10 by inserting pin means 80 through the apertures 75*a*, 75*b* of ears 73*a*, 73*b* and threading the nut 80 onto the end of the bolt forming pin means 80, as best shown in FIG. 17.

It should be noted that the third embodiment has a distinct advantage over the first two embodiments; i.e., the ability of positively securing the mailbox via pin means 80 to the terminal wall 10 of the pipe support means 5 when the arm is placed into the unextended position. It should also be noted that pin means 80 positively secures the mailbox 2 into its proper orientation onto arm 20 when arm 20 is placed into the extended position.

In operation, the mailbox support of each of the three preferred embodiments is vertically withdrawn from the storage recess 6 of pipe support member 5 until the stopping means 31 of the proximal pivotal mounting 30 engages the lower surface 13 of terminal wall 10. The arm 20 is then pivoted downwardly into the horizontal position illustrated in FIGS. 2, 8 and 16. In all three embodiments, the mailbox 2 is reoriented back into an operable, horizontal position from the phantom positions shown in FIGS. 3, 9 and 16 by pivoting the mailbox 2 ninety degrees on the distal pivotal mounting 50. In the first embodiment, the counterclockwise pivoting of the mailbox 2 locks or secures the locking portion 24*a* of the elongated tongue 23 through tongue-receiving slot 35. The consequent abutment of locking portion 24*a* against the upper surface 12 of terminal wall 10 secures extension arm 20 in the horizontal position. In the second and third embodiments, the extension arm 20 is slid in a direction toward pipe support member 5 so that the proximal end 21 of extension arm 20 overhangs support member 5 in the position best illustrated in FIGS. 8 and 16. In the third embodiment, the mailbox 2 may be positively secured in the horizontal position by inserting ears 73*a*, 73*b* through slots 41*a*, 41*b*, respectively, and inserting pin means 80 through pin-receiving apertures 75*a*, 75*b* as previously explained. In all three embodiments, the extension arm 20, along with its proximal pivotal mounting 30 and distal pivotal mounting 50, may be completely withdrawn back into the storage recess 6 of the pipe support member 5 in the positions shown in FIGS. 5, 12 and 17.

Although the present invention has been described in terms of three preferred embodiments, various changes, modifications and adaptations of the invention will occur to persons of ordinary skill in the art. For example, extension arm 20 may be made from a series of telescoping sections if a longer extension arm is desired. Such a structure would have the advantage of providing an extension arm with a substantially longer extension capacity which would still be storable within the hollow interior of the support member. Additionally, a pivoting forty-five degree angle could be built into the bottom section of the extension arm to brace the arm against the support member 5 in order to give the arm extra strength. Many other changes, modifications and adaptations fall within both the spirt of the invention and the scope of the claims appended hereto.

What is claimed is:

1. An extendable mailbox support for selectively supporting a mailbox in either an unextended or a horizontally extended position, comprising:

(a) a support member including a recess;

(b) an extension arm for horizontally extending said mailbox which is slidably extendable out of and retractable into said recess and which connects said mailbox to said support member, wherein said arm includes:

(i) a proximal pivotal mounting on its proximal end for supporting said mailbox in said horizontally extended position when said arm is slidably extended out of said recess and pivoted, and (ii) a distal pivotal mounting on its distal end for reorienting said mailbox back into its initial orientation when said arm is slidably extended out of said recess and pivoted into a generally horizontal position wherein said proximal pivotal mounting is completely retractable into said recess when said extension arm is retracted into the recess of the support member.

2. The extendable mailbox support defined in claim 1, wherein said support member is a hollow elongated member, and wherein the interior of said member comprises said recess.

3. The extendable mailbox support defined in claim 2, wherein said proximal pivotal mounting includes a stopping member for stopping said extension arm from being completely withdrawn from said recess, and a locking member for locking said extension arm into said extended position.

4. The extendable mailbox support defined in claim 3, wherein said locking member includes an elongated tongue slidably extendable out of and retractable into a recess in said arm.

5. The extendable mailbox support defined in claim 4, wherein the distal end of said tongue is attached to the distal pivotal mounting, and wherein the other end of said tongue functions to lock said extension arm into said extended position when said mailbox is reoriented after said arm is slidably extended out of said recess of said support member and pivoted into said extended position.

6. The extendable mailbox support defined in claim 5, wherein said stopping member of said proximal pivotal mounting of said extension arm includes a T-shaped plate connected to the proximal end of said arm, wherein said T-shaped member includes an aperture through which the locking end of said elongated tongue extends out of when said arm is extended and pivoted into said extended position.

7. The extendable mailbox support defined in claim 6, wherein said support member terminates in a wall including an aperture, and wherein the hat of said T-shaped plate of said proximal pivotal mounting stops said arm from being completely withdrawn from the hollow interior of said support member, and pivots against the interior of said support member wall when said arm is placed in an extended position, and said locking end of said elongated tongue extends over a portion of the exterior of said support member wall when said arm is placed in an extended position.

8. The extendable mailbox support defined in claim 7, wherein said distal pivotal mounting includes a mailbox plate having a top wall for mounting said mailbox onto said arm, and a bottom wall including a pair of opposing, parallel flanges for receiving the distal end of said arm.

9. The extendable mailbox support defined in claim 8, wherein said distal pivotal mounting includes a pin, and wherein said opposing flanges of said mailbox plate include apertures for receiving said pin, and wherein the distal end of said arm includes an elongated slot for receiving said pin, and wherein the distal end of said elongated tongue includes an aperture for receiving said pin.

10. The extendable mailbox support defined in claim 1, wherein said proximal pivotal mounting includes a stopping member for stopping said extension arm from being completely withdrawn from said recess.

11. The extendable mailbox support defined in claim 10, wherein said support member is a hollow elongated member, and wherein the hollow interior of said member comprises said recess.

12. The extendable mailbox support defined in claim 11, wherein said hollow elongated member terminates in a wall having an aperture through which said arm is slidably extendable out of and retractable into said recess, and wherein said stopping member abuts the interior of said wall when said arm is placed in said extended position.

13. The extendable mailbox support defined in claim 12, wherein said stopping member includes a substantially round plate of larger diameter than said aperture in said terminal wall of said elongated member, and said plate includes a pair of opposing ears on its upper wall which extend through said aperture and above said terminal when said arm is placed in an extended position.

14. The extendable mailbox support defined in claim 13, further including a pin wherein each of said ears includes an aperture for receiving said pin, and wherein the proximal end of said arm includes an elongated slot for receiving said pin, whereby the proximal end of said arm secures said arm in said extending position when said arm is withdrawn from the hollow interior of said elongated support member and pivoted and slid between the ears of said round plate.

15. The extendable mailbox support defined in claim 14, wherein said distal pivotal mounting includes a round mailbox plate having a pair of opposing, parallel ears extending from its bottom wall, and wherein the distal end of said arm is receivable between said ears.

16. The extendable mailbox support defined in claim 15, wherein said distal pivotal mounting includes a pin, and wherein said opposing ears of said mailbox plate include apertures for receiving said pin, and wherein the distal end of said arm includes an elongated slot for receiving said pin, whereby said distal end of said arm is pivotally and slidably mounted between the ears of said round mailbox plate.

17. The extendable mailbox support defined in claim 14, wherein said distal pivotal mounting includes a rectangular mailbox plate having a top wall including a pair of opposing flanges for receiving the bottom portion of a mailbox.

18. The extendable mailbox support defined in claim 17, further including first and second pins, wherein said rectangular mailbox plate includes first and second pairs of opposing ears, each of which includes an aperture for receiving said first and second pins, respectively, and wherein said distal end of said arm includes a pin receiving slot and a pin receiving aperture which may be placed in registry with the apertures in said first and second pair of opposing ears, respectively, and wherein said first pin pivotally and slidably mounts said distal end of said arm between the first pair of opposing ears of said rectangular mailbox plate, and said second pin secures the orientation of said mailbox when said arm is extended.

19. The extendable mailbox support defined in claim 17 wherein said terminal wall of said hollow support member includes a pair of slots for receiving said second pair of opposing ears when said mailbox is in said unextended position, and wherein said second pin secures the orientation of said mailbox when said arm is unextended.

20. An extendable mailbox support for selectively supporting a mailbox in either an unextended or a horizontally extended position, comprising:

(a) a support member including a recess;

(b) an extension arm for horizontally extending said mailbox which is slidably extendable out of and completely retractable into said recess and which connects said mailbox to said support member, wherein said arm includes:

(i) a proximal pivotal mounting for supporting said mailbox in said horizontally extended position and for rotatably mounting said mailbox onto said support member when said arm is slidably extended out of said recess and pivoted, and (ii) a distal pivotal mounting for reorienting said mailbox back into its initial orientation when said arm is slidably extended out of said recess and pivoted into said generally horizontal position.

* * * * *